US009765586B2

(12) United States Patent
Wright et al.

(10) Patent No.: US 9,765,586 B2
(45) Date of Patent: Sep. 19, 2017

(54) RADIO FREQUENCY AND FLUID COUPLER FOR A SUBTERRANEAN ASSEMBLY AND RELATED METHODS

(71) Applicant: HARRIS CORPORATION, Melbourne, FL (US)

(72) Inventors: Brian N. Wright, Indialantic, FL (US); Raymond C. Hewit, Palm Bay, FL (US); Nathan S. Denver, Indialantic, FL (US); Stephen J. Kolvek, Ridgewood, NJ (US); Arthur H. White, Township of Washington, NJ (US); Brian P. Smith, West Melbourne, FL (US)

(73) Assignee: HARRIS CORPORATION, Melbourne, FL (US)

( * ) Notice: Subject to any disclaimer, the term of this patent is extended or adjusted under 35 U.S.C. 154(b) by 214 days.

(21) Appl. No.: 14/700,807

(22) Filed: Apr. 30, 2015

(65) Prior Publication Data

US 2016/0319621 A1 Nov. 3, 2016

(51) Int. Cl.
*E21B 33/03* (2006.01)
*E21B 43/24* (2006.01)
(Continued)

(52) U.S. Cl.
CPC ..... *E21B 33/03* (2013.01); *E21B 17/003* (2013.01); *E21B 36/04* (2013.01); *E21B 43/2401* (2013.01)

(58) Field of Classification Search
CPC ..... E21B 33/03; E21B 36/04; E21B 17/003; E21B 43/2401
See application file for complete search history.

(56) References Cited

U.S. PATENT DOCUMENTS 2,804,293 A * 8/1957 Parks ..... E21B 3/02 175/210
RE24,609 E * 2/1959 Johnson ..... E21B 33/03 166/88.1

(Continued)

OTHER PUBLICATIONS

Wright, U.S. Appl. No. 14/076,501, filed Nov. 11, 2013.

(Continued)

*Primary Examiner* — David Bagnell
*Assistant Examiner* — Jonathan Malikasim
(74) *Attorney, Agent, or Firm* — Allen, Dyer, Doppelt + Gilchrist, P.A.

(57) ABSTRACT

A radio frequency (RF) and fluid coupler is for a subterranean assembly. The assembly may have a fluid passageway therein, and may include an RF antenna and a coaxial transmission line connected thereto. The coupler may include an electrically conductive hollow body that includes electrically conductive segments connected together in end-to-end relation at respective joints to provide an outer electrical pathway to connect to the outer conductor of the coaxial transmission line. An elongate conductive member may extend within the electrically conductive hollow body to provide an inner electrical pathway to connect to the inner conductor of the coaxial transmission line. A respective dielectric pressure barrier may be between the elongate conductive member and adjacent portions of the electrically conductive hollow body adjacent each of a pair of joints to define a fluid chamber to connect to the fluid passageway. A fluid port may be connected to the fluid chamber.

19 Claims, 6 Drawing Sheets

(51) Int. Cl.
*E21B 17/00* (2006.01)
*E21B 36/04* (2006.01)

(56) References Cited

U.S. PATENT DOCUMENTS

| | | | | |
|---|---|---|---|---|
| 3,113,196 | A * | 12/1963 | Spooner | H01H 1/36 200/267 |
| 3,638,732 | A | 2/1972 | Huntsinger et al. | |
| 4,491,176 | A | 1/1985 | Reed | |
| 5,065,819 | A | 11/1991 | Kasevich | |
| 5,745,047 | A | 4/1998 | Van Gisbergen et al. | |
| 6,394,837 | B1 | 5/2002 | Edwards et al. | |
| 7,461,693 | B2 | 12/2008 | Considine et al. | |
| 8,149,177 | B1 * | 4/2012 | Callus | H01Q 1/286 343/705 |
| 8,186,445 | B2 | 5/2012 | Monjure | |
| 8,322,440 | B2 | 12/2012 | Christie | |
| 8,758,055 | B2 * | 6/2014 | McAlonis | H01R 13/518 439/607.01 |
| 2005/0051341 | A1 | 3/2005 | Khazanovich et al. | |
| 2006/0180304 | A1 | 8/2006 | Kasevich | |
| 2014/0014325 | A1 | 1/2014 | Blue et al. | |
| 2014/0043115 | A1 | 2/2014 | Wright et al. | |

OTHER PUBLICATIONS

Wright et al., U.S. Appl. No. 14/491,530, filed Sep. 19, 2014.
Wright et al., U.S. Appl. No. 14/491,563, filed Sep. 19, 2014.
Wright et al., U.S. Appl. No. 14/491,545, filed Sep. 19, 2014.

* cited by examiner

RADIO FREQUENCY AND FLUID COUPLER FOR A SUBTERRANEAN ASSEMBLY AND RELATED METHODS

FIELD OF THE INVENTION

The present invention relates to the field of couplers, and more particularly, to radio frequency and fluid couplers for subterranean assemblies.

BACKGROUND

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

To further increase hydrocarbon resource recovery efficiency, radio frequency (RF) energy may be used to provide heating. U.S. Patent Application Publication No. 2006/0180304 to Kasevich discloses a hydrocarbon recovery process whereby an RF antenna is positioned within a borehole. RF energy is supplied to the RF antenna to heat the hydrocarbon resources. The hydrocarbon resources are recovered from the borehole.

Fluids may also be injected into the borehole to increase hydrocarbon resource recovery efficiency. For example, nitrous oxide and carbon dioxide may be injected into the borehole.

Underground RF heating generally requires a device that can supply relatively large amounts of RF power to the antenna in the subterranean formation while maintaining fluid and/or gas control both in and out of the subterranean formation. U.S. Pat. No. 7,461,693 to Considine et al. discloses a wellhead assembly or interface that allows fluid or gas and RF to be communicated from above the subterranean formation to the wellbore within the subterranean formation.

Despite the existence of such a wellhead assembly, such systems may not be relatively reliable and robust. For example, such systems may not provide desired isolation and pressure control, while maintaining desired power levels. For example, it may be particularly desirable to maintain or control the coefficient of thermal expansion (CTE) growth, the temperature of the components, e.g., antennas, chokes, etc., and overall control of the well.

SUMMARY

A radio frequency (RF) and fluid coupler may be for a subterranean assembly that may include an RF antenna and a coaxial transmission line connected thereto. The coaxial transmission line may include an inner conductor and an outer conductor surrounding the inner conductor. The subterranean assembly may have at least one fluid passageway therein. The RF and fluid coupler may include an electrically conductive hollow body that includes electrically conductive segments connected together in end-to-end relation at respective joints to provide an outer electrical pathway to connect to the outer conductor of the coaxial transmission line. An elongate conductive member may extend within the electrically conductive hollow body to provide an inner electrical pathway to connect to the inner conductor of the coaxial transmission line. A respective dielectric pressure barrier may be between the elongate conductive member and adjacent portions of the electrically conductive hollow body adjacent each of a pair of joints to define at least one fluid chamber to connect to the at least one fluid passageway of the subterranean assembly. A fluid port may be connected to the at least one fluid chamber. Accordingly, relatively large amounts of power may be provided to the RF antenna while providing increased control, for example of CTE growth, the temperature of the components, pressure, and overall well parameters.

The RF and fluid coupler may further include at least one RF contact between adjacent ones of the plurality of electrically conductive segments at respective joints. The at least one RF contact may include at least one conductive wound spring, for example. The at least one conductive wound spring may have a generally rectangular shape, for example.

The respective joints may each include a respective slip joint. Each respective dielectric pressure barrier may include quartz fiber, for example. The RF and fluid coupler may further include at least one seal between adjacent ones of the plurality of electrically conductive segments at a respective joint.

Each of the plurality of electrically conductive segments may have an enlarged width flange at each joint and a plurality of fastener receiving passageways therein. A respective fastener may be within each fastener receiving passageway.

Each of the electrically conductive segments may include a base material and an electrically conductive material layer on the base material, for example. Each of the electrically conductive segments may include brass.

A method aspect is directed to a method of making a radio frequency (RF) and fluid coupler for a subterranean assembly that includes an RF antenna and a coaxial transmission line connected thereto. The coaxial transmission line includes an inner conductor and an outer conductor surrounding the inner conductor. The subterranean assembly has at least one fluid passageway therein. The method may include forming an electrically conductive hollow body that includes a plurality of electrically conductive segments connected together in end-to-end relation at respective joints to provide an outer electrical pathway to connect to the outer conductor of the coaxial transmission line. The method may also include forming an elongate conductive member to extend within the electrically conductive hollow body to provide an inner electrical pathway to connect to the inner conductor of the coaxial transmission line. The method may further include positioning a respective dielectric pressure barrier between the elongate conductive member and adjacent portions of the electrically conductive hollow body adjacent each of a pair of joints to define at least one fluid chamber to connect to the at least one fluid passageway of the subterranean assembly. A fluid port may be formed that is connected to the at least one fluid chamber.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
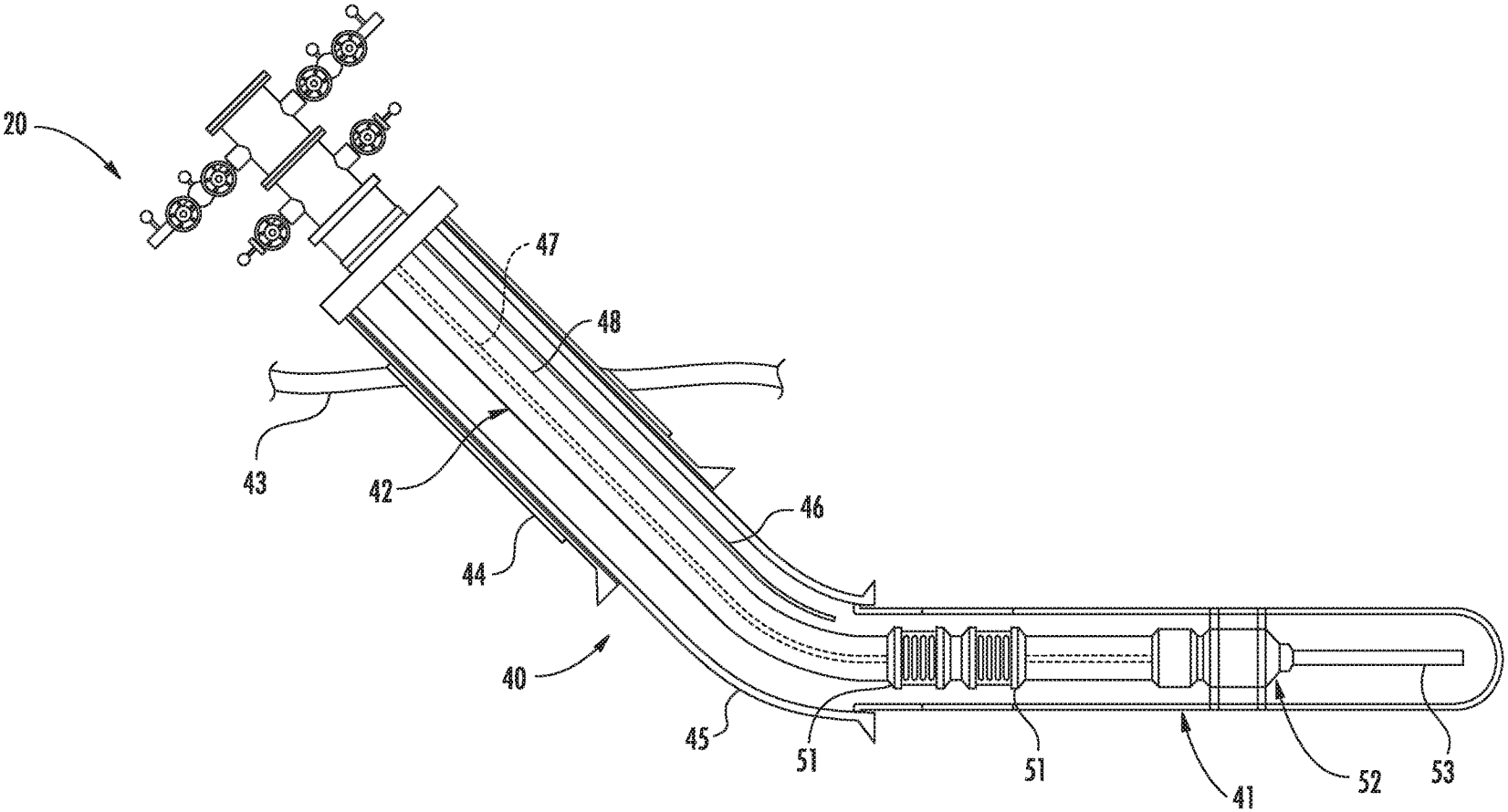
FIG. 1 is a schematic diagram of an RF and fluid coupler and a subterranean assembly in accordance with an embodiment of the present invention.

Referring initially to FIG. 1, a radio frequency (RF) and fluid coupler 20 for a subterranean assembly 40 is now described. The subterranean assembly 40 includes an RF antenna 41 and a coaxial transmission line 42 connected thereto that extend within a wellbore in a subterranean formation 43. A surface casing 44 and intermediate casing 45 may be positioned in the wellbore.

The RF antenna 41 may be a dipole antenna, for example, or any other type of antenna, and may be a liner, for example, a slotted liner, as will be appreciated by those skilled in the art. The subterranean assembly 40 also has a fluid passageway 46 therein, for example, for cooling fluid for the coaxial transmission line 42. The fluid passageway 46 may be particularly advantageous for the passage of a solvent, steam, or other fluid for use in the recovery of hydrocarbon resources. Of course, the subterranean assembly 40 may have any number of fluid passageways therein, for example, a single fluid passageway. Further details of fluid passageways will be described in detail below.

The coaxial transmission line 42 includes an inner conductor 47 and an outer conductor 48 surrounding the inner conductor. The coaxial transmission line 42 may be coupled in the wellbore, which may be laterally extending, to various components, for example, the antenna 41, one or more chokes 51, a tool head assembly 52, a guide string 53, and other components, as will be appreciated by those skilled in the art. Example subterranean assemblies and coaxial transmission lines can be found in application Ser. Nos. 14/076,501, 14/491,530, 14/491,563, and 14/491,545, all of which are assigned to the present assignee, and the entire contents of each of which is hereby incorporated by reference.

Referring now additionally to FIGS. 2-6, the RF and fluid coupler 20 includes an electrically conductive hollow body 21 that includes electrically conductive segments 22*a*, 22*b* connected together in end-to-end relation at respective joints 28*a*, 28*b*. The electrically conductive segments 22*a*, 22*b* each include a base material 23*a*, 23*b*, for example steel, and an electrically conductive material layer 24*a*, 24*b* on the base material, for example copper. The electrically conductive material layer 24*a*, 24*b* may be electroplated on the base material 23*a*, 23*b*, for example, and may have a thickness in the range of 50-60 mils. Of course, the thickness may be within another range, for example, that may be based upon a desired operational frequency of the antenna and the desired skin depth for current transfer. In some embodiments, the electrically conductive material layer 24*a*, 24*b* may also or additionally be pressed. In other embodiments, a free fit electrically conductive tube may be used.

Figure 7:
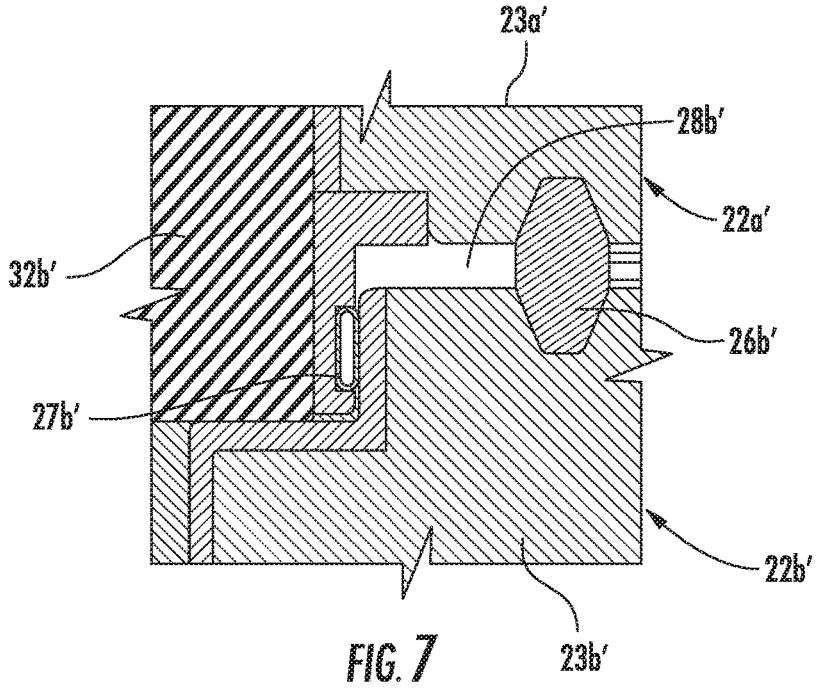
FIG. 7 is an enlarged cross-sectional view of an RF contact and seal of an RF and fluid coupler in accordance with another embodiment of present invention.

Referring briefly to FIG. 7, in other embodiments, the electrically conductive segments 22*a*', 22*b*' may be formed monolithically of a single material 23*a*', 23*b*', for example, brass. It should be noted that single material electrically conductive segments 22*a*', 22*b*' may have a lower pressure handling capability.

The electrically conducive hollow body 21 provides an outer electrical pathway to connect to the outer conductor 48 of the coaxial transmission line 42. It will be appreciated that any number of electrically conducive segments may be used, and coupled in the end-to-end relation, for example.

The electrically conductive hollow body 21 illustratively varies in diameter or width along a length thereof. For example, the electrically conductive hollow body 21 changes diameter adjacent an output fluid port 25. The changing diameter may advantageously allow for transitions between different sized, for example, from non-standard to standard, electrically conductive hollow bodies and/or RF transmission lines while maintaining thermal control. A valve 71 is coupled to the output fluid port 25.

Figure 6:
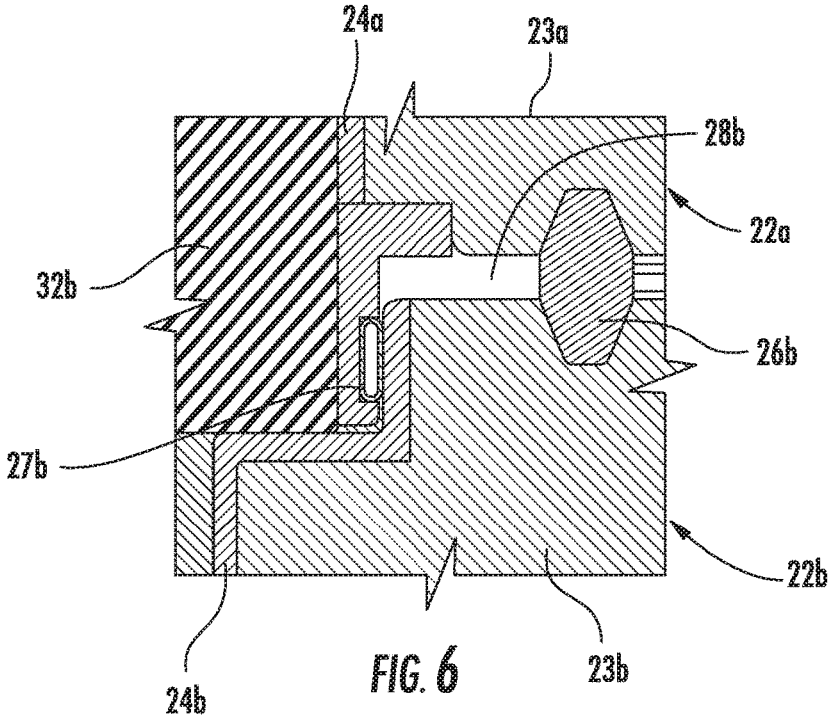
FIG. 6 is an enlarged cross-sectional view of the RF contact and seal of the RF and fluid coupler of FIG. 2.

A respective seal 26*a*-26*c* is between adjacent electrically conductive segments 22*a*, 22*b* at the respective joint 28*a*-28*c* (FIG. 6). Each seal 26*a*-26*c* may be in the form of a ring gasket (i.e., an O-ring), for example. The seal 26*a*-26*c* may be exposed to a pressure of about 1500 psi, for example, under normal operating conditions.

A respective RF contact 27*a*-27*c* is between adjacent electrically conductive segments 22*a*, 22*b* at respective joints 28*a*-28*c*, which may be slip joints. Each RF contact 27*a*-27*c* is illustratively in the form of a conductive wound spring and has a generally rectangular shape, and for example may be considered a watch band RF contact (FIG. 6). Of course, other or additional types of RF contacts may be used and may have a different shape. For example, the RF contacts 27*a*-27*c* may be stamped Beryllium-Copper (BeCu) in the form of "fingers" or having a generally rectangular shape. Also, it will be appreciated that a different type of RF contact may be at each joint 28*a*-28*c*. The RF contacts 27*a*-27*c* advantageously allows compression of the seal 26*a*-26*c* while taking little, if any, load. The number of RF contacts 27*a*-27*c* may be determined based upon a desired contact length, as will be appreciated by those skilled in the art.

An elongate conductive member 31 extends within the electrically conductive hollow body 21 to provide an inner electrical pathway to connect to the inner conductor of the coaxial transmission line 42. For example, the elongate member 31 along with the electrically conducive hollow body 21 may be coupled to an RF source above the subterranean formation 43 so that RF energy is supplied at to the antenna 41 via the RF transmission line 42.

A respective dielectric pressure barrier 32*a*-32*c* is between the elongate conductive member 31 and adjacent portions of the electrically conductive hollow body 21 adjacent each of a pair of joints 28*a*-28*c* defining respective fluid chambers 33*a*, 33*b* to connect to a respective fluid passageway or port. The fluid output port 25 is connected to the fluid chamber 33*b*. While a fluid port 25 is described as an output port, the fluid port may be an input fluid port corresponding to and connecting with a particular fluid passageway and/or fluid flow direction.

The elongate conductive member 31 may be hollow or tubular to define a fluid passageway 34 therein. Slots 37 or openings may be in the elongate conductive member 31 adjacent the fluid chamber 33*b* to allow the passage of a fluid from within the elongate conductive member through the fluid chamber and to the output fluid port 25. In particular, two uppermost dielectric pressure barriers 32*a*, 32*b* act as pressure barriers for the fluid with the uppermost dielectric pressure barrier 32*a* being redundant. The dielectric pressure barriers 32*a*-32*c* restrict the fluid from the fluid passageway 34 to the fluid chamber 33*b* thus allowing the fluid to flow thorough the output fluid port 25. The fluid chamber 33*a* is redundant is and is not coupled to a fluid port. In other embodiments, the fluid chamber 33*a* may be coupled to a fluid port and/or fluid passageway, and may not be redundant.

The RF and fluid coupler 20 may also include further electrically conductive hollow segments 22*c*, 22*d* coupled between the subterranean assembly 40 and the electrically conductive hollow segments 22*a*, 22*b*. A respective dielectric pressure barrier is not coupled between adjacent further electrically conductive segments 22*c*, 22*d* at respective joints therebetween. A fluid inlet port 66 is coupled to a fluid passageway 36 defined by an annulus, for example an outer annulus, of each of the further electrically conductive segments 22*c*, 22*d*, and particular, electrically conductive segment 22*d*. Of course, the inlet port 66 may be coupled to or in fluid communication with another fluid passageway or annulus. As will be appreciated by those skilled in the art, a fluid, for example a cooling fluid, may be passed through the fluid input port 66 and may return via the fluid passageway 34 to the fluid cavity 33*b* and through the fluid output port 25. A valve 72 is coupled to the fluid output port 66.

Illustratively, the outer fluid passageway 36 is blocked from an annulus or corresponding fluid passageway of an adjacent further electrically conductive segment 22*c*. This allows, in this configuration, the fluid passage from the fluid inlet port 66 to flow in the downhole direction. Of course, any number of annuli or fluid passageways may exist and each passageway may be for any type of fluid.

Another fluid passageway 35 is defined by the space between the electrically conductive hollow body 21 and the elongate conductive member 31. The fluid passageway 35 may also be for dielectric fluid, for example, and may allow the passage of a dielectric such as $N_2$. The dielectric pressure barrier 32*c* may thus act as a pressure barrier for the fluid, for example, for the $N_2$.

Each respective dielectric pressure barrier 32*a*-32*c* may include quartz fiber, for example, to provide increased strength and CTE matching. Of course each respective dielectric pressure barrier 32*a*-32*c* may be another type of material, for example a fiberglass cloth (i.e., S-Glass), a polymer, such as for example, polyether ether ketone (PEEK) or fiber reinforced perfluoroalkoxy alkanes (PFA). Each dielectric pressure barrier 32*a*-32*c* may be particularly advantageous for reducing a blow out associated with the corresponding fluid passageway 34, 35. Multiple or redundant dielectric pressure barriers 32*a*, 32*b* may be associated with a given fluid passageway 34 as described above.

It may be desirable for each respective dielectric pressure barrier 32*a*-32*c* and electrically conductive hollow body 21 to have a coefficient of thermal expansion (CTE) within ±10% of each other, for example. As will be appreciated by those skilled in the art, a relatively small, if any, CTE mismatch is particularly advantageous for maintaining or controlling thermal growth, and, thus, may provide increased ease of maintenance.

Figure 2:
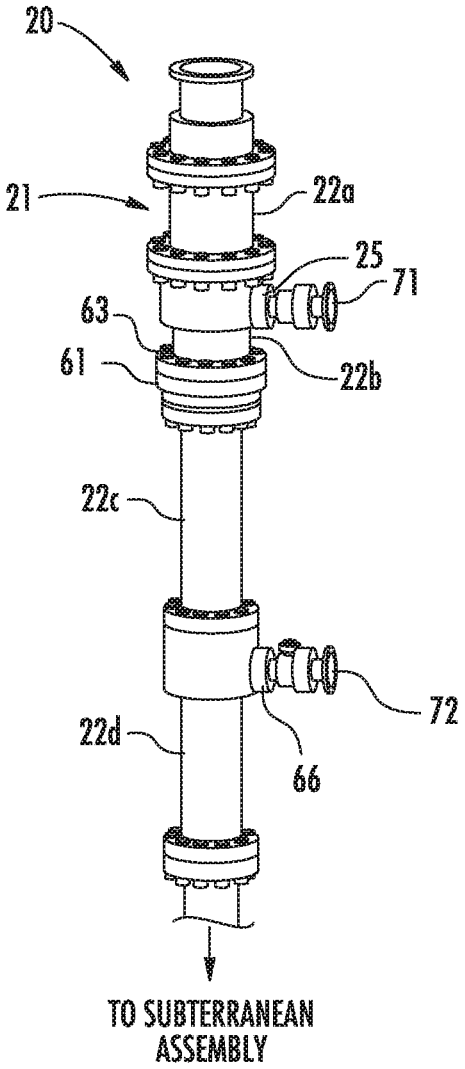
FIG. 2 is a perspective view of an RF and fluid coupler in accordance with the present invention.
Figure 3:
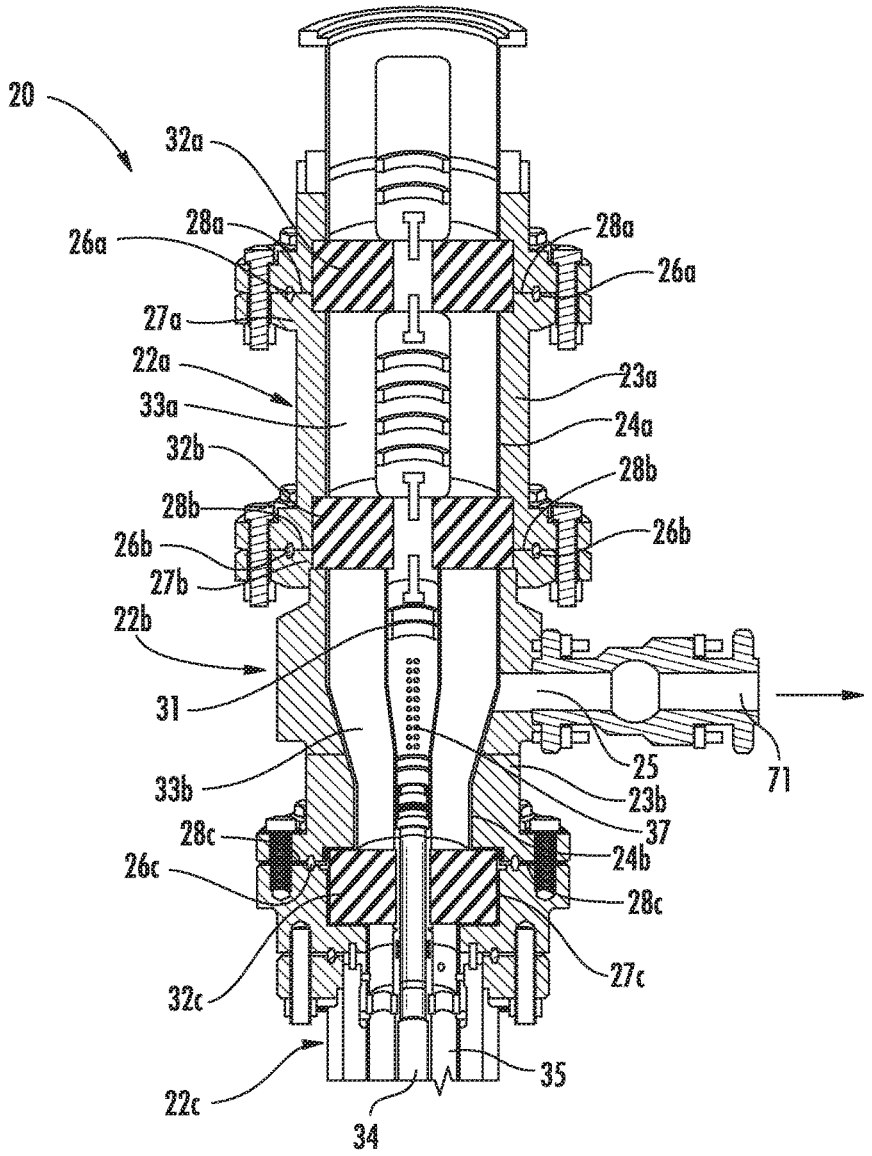
FIG. 3 is an enlarged cross-sectional view of an upper portion of the RF and fluid coupler of FIG. 2.
Figure 4:
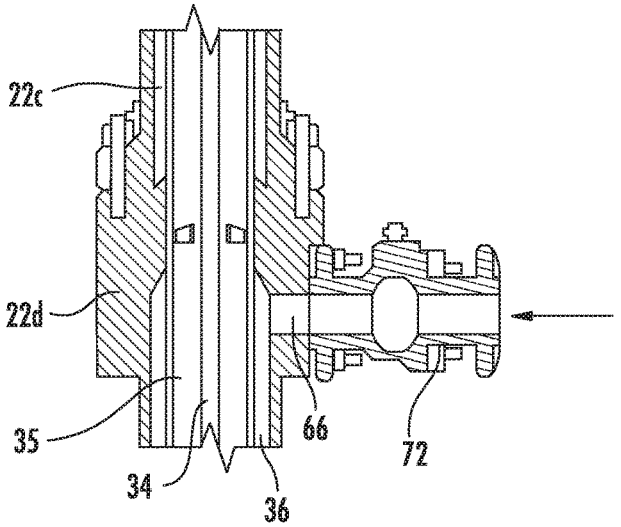
FIG. 4 is an enlarged cross-sectional view of a lower portion of the RF and fluid coupler of FIG. 2.
Figure 5:
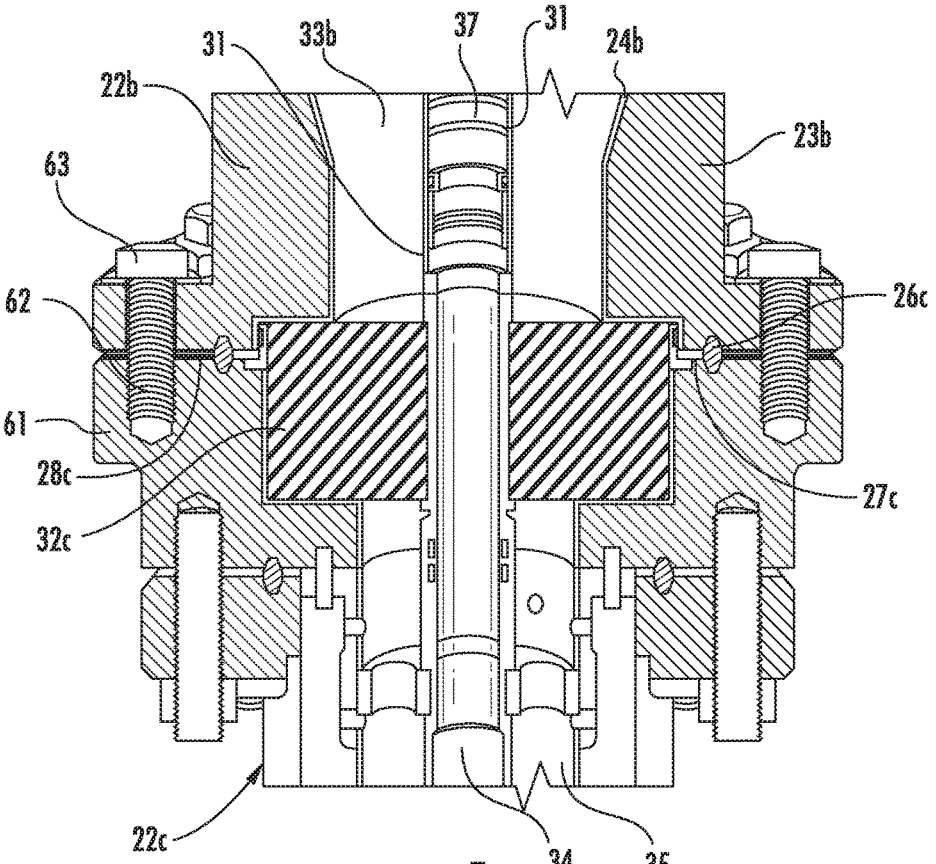
FIG. 5 is another enlarged cross-sectional view of the upper portion of the RF and fluid coupler of FIG. 2.

Each of the electrically conductive segments 22*a*, 22*b* illustratively has an enlarged width flange 61 at each joint 28*a*-28*c*, and also has fastener receiving passageways 62 therein (FIGS. 2 and 5). A respective fastener 63 is within each fastener receiving passageway 62 to couple adjacent electrically conductive segments 22*a*-22*d* (FIGS. 2 and 5). Of course, other techniques or features may be used to couple or fasten adjacent electrically conductive segments 22*a*-22*d*.

As will be appreciated by those skilled in the art, the RF and fluid coupler 20 may be particularly advantageous for the transmission of RF energy into a well for purpose of heating hydrocarbon resources, for example by meeting ECRB and API well control and strength standards in a pressure vessel body, i.e., fluid chamber, and by controlling multiple pressuring fluid passageways. Additionally, the apparatus may provide increased containment and isolation of hydrocarbon resources, for example, in the event of a failure. RF power transmission losses into the well may also be reduced.

The RF and fluid coupler 20 described herein may also provide increased pressure containment that is compatible with hydrocarbon chemicals, for example, and may also provide increased isolation of the fluid chambers through the use of the dielectric pressure barrier 32*a*-32*c*. Still further, the RF and fluid coupler 20 may provide for seal testing and pressure balancing of multiple annuli or fluid passageways, and isolation of high to low pressure zones. Gas pressurization may also advantageously maintain voltage standoff, as will be appreciated by those skilled in the art.

Figure 8:
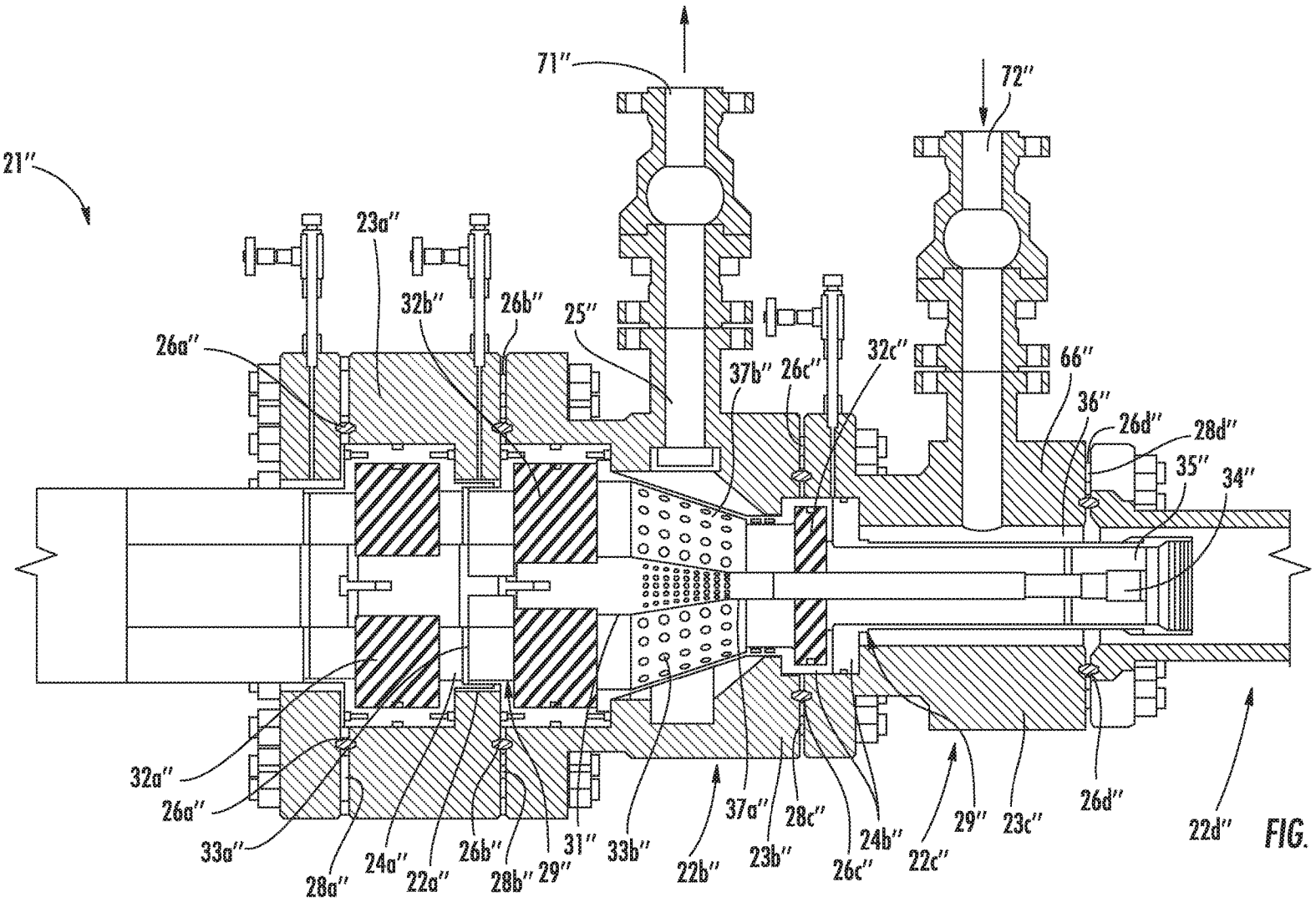
FIG. 8 is an enlarged cross-sectional view of a portion of an RF and fluid coupler according to another embodiment of the present invention.

Referring now to FIG. 8, another embodiment of a fluid coupler 20" is illustrated. The fluid coupler 20" includes an electrically conductive hollow body 21" that includes electrically conductive segments 22*a*"-22*d*" connected together in end-to-end relation at respective joints 28*a*"-28*d*". The electrically conductive segments 22*a*"-22*c*" each include a base material 23*a*"-23*c*", for example steel. The electrically conductive segments 22*a*"-22*c*" also include an electrically conductive material layer 24*a*", 24*b*" on the base material, for example brass. Illustratively, the electrically conductive material layer 24*a*", 24*b*" defines an electrically conductive tube 29" extending from the first electrically conductive segment 22*a*" to the joint 28*c*" between the second and third electrically conductive segments 22*b*", 22*c*". In other words, with respect to the electrically conductive tube 29", the present embodiment is considered a non-plated approach, for example, which may in contrast to a plated approach, for example, an approach of which is described above and illustrated in FIG. 3. As will be appreciated by those skilled in the art, the electrically conductive tube 29" may have a lower risk of failure and thus damage to other or adjacent components compared to the plated approach.

Similar to the embodiments described above, the electrically conductive hollow body 21" illustratively varies in diameter or width along a length thereof. For example, the electrically conductive hollow body 21" changes diameter adjacent an output fluid port 25". A valve 71" is coupled to the output fluid port 25".

A respective seal 26*a*"-26*d*" is between adjacent electrically conductive segments 22*a*"-22*d*" at the respective joint 28*a*"-28*d*". Each seal 26*a*"-26*d*" may be in the form of a ring gasket (i.e., an O-ring), for example, and be similar to those described above.

In the present embodiment, the electrically conductive material layer 24*a*", 24*h*" defines an RF contact between adjacent electrically conductive segments 22*a*"-22*c*" at respective joints 28*a*"-28*d*". An elongate conductive member 31" extends within the electrically conductive hollow body 21" to provide an inner electrical pathway to connect to the inner conductor of the coaxial transmission line. For example, the elongate member 31" along with the electrically conducive hollow body 21" may be coupled to an RF source above the subterranean formation so that RF energy is supplied at to the antenna via the RF transmission line.

A respective dielectric pressure barrier 32*a*"-32*c*" is between the elongate conductive member 31" and adjacent portions of the electrically conductive hollow body 21" adjacent each of a pair of joints 28*a*"-28*c*" defining respective fluid chambers 33*a*", 33*h*" to connect to a respective fluid passageway or port. The fluid output port 25" is connected to the fluid chamber 33*b*". While a fluid port 25" is described as an output port, the fluid port may be an input fluid port corresponding to and connecting with a particular fluid passageway and/or fluid flow direction.

The elongate conductive member 31" may be hollow or tubular to define a fluid passageway 34" therein. Slots 37*a*" or openings may be in the elongate conductive member 31" adjacent the fluid chamber 33*b*" to allow the passage of a fluid from within the elongate conductive member through the electrically conductive tube 29", which also has slots 37*b*" therein adjacent the slots 37*a*", and through the fluid chamber and to the output fluid port 25". Similar to the embodiment described above, a fluid inlet port 66" is coupled to a fluid passageway 36" defined by an annulus, for example an outer annulus, of each of the electrically conductive segments 22*c*", 22*d*". A valve 72" is coupled to the fluid output port 66". Another fluid passageway 35" is defined by the space between the electrically conductive hollow body 21" and the elongate conductive member 31".

A method aspect is directed to a method of making a radio frequency (RF) and fluid coupler 20 for a subterranean assembly 40 that includes an RF antenna 41 and a coaxial transmission line 42 connected thereto. The coaxial transmission line 42 includes an inner conductor 47 and an outer conductor 48 surrounding the inner conductor. The subterranean assembly 40 has at least one fluid passageway 46 therein. The method includes forming an electrically conductive hollow body 21 that includes a plurality of electrically conductive segments 22*a*-22*d* connected together in end-to-end relation at respective joints to provide an outer electrical pathway to connect to the outer conductor 48 of the coaxial transmission line 42. The method also includes forming an elongate conductive member 31 to extend within the electrically conductive hollow body 21 to provide an inner electrical pathway to connect to the inner conductor 47 of the coaxial transmission line 42. The method further includes positioning a respective dielectric pressure barrier 32*a*-32*d* between the elongate conductive member 31 and adjacent portions of the electrically conductive hollow body 21 adjacent each of a pair of joints 28*a*-28*c* to define at least one fluid chamber 33*a*, 33*b* to connect to the at least one fluid passageway 46 of the subterranean assembly 40. The method further includes forming a fluid port 25 connected to the at least one fluid chamber 33*b*.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A radio frequency (RF) and fluid coupler for a subterranean assembly comprising an RF antenna and a coaxial transmission line connected thereto, the coaxial transmission line comprising an inner conductor and an outer conductor surrounding the inner conductor, the subterranean assembly having at least one fluid passageway therein, the RF and fluid coupler comprising:

an electrically conductive hollow body comprising a plurality of electrically conductive segments connected together in end-to-end relation at respective joints to provide an outer electrical pathway to connect to the outer conductor of the coaxial transmission line;

an elongate conductive member extending within said electrically conductive hollow body to provide an inner electrical pathway to connect to the inner conductor of the coaxial transmission line;

a respective dielectric pressure barrier between said elongate conductive member and adjacent portions of said electrically conductive hollow body adjacent each of a pair of joints to define at least one fluid chamber to connect to the at least one fluid passageway of the subterranean assembly; and a fluid port connected to the at least one fluid chamber.

2. The RF and fluid coupler according to claim 1 further comprising at least one RF contact between adjacent ones of said plurality of electrically conductive segments at respective joints.

3. The RF and fluid coupler according to claim 2 wherein said at least one RF contact comprises at least one conductive wound spring.

4. The RF and fluid coupler according to claim 3 wherein said at least one conductive wound spring has a generally rectangular shape.

5. The RF and fluid coupler according to claim 1 wherein each respective dielectric pressure barrier comprises quartz fiber.

6. The RF and fluid coupler according to claim 1 further comprising at least one seal between adjacent ones of said plurality of electrically conductive segments at a respective joint.

7. The RF and fluid coupler according to claim 1 wherein each of said plurality of electrically conductive segments has an enlarged width flange at each joint and a plurality of fastener receiving passageways therein; and further comprising a respective fastener within each fastener receiving passageway.

8. The RF and fluid coupler according to claim 1 wherein each of said electrically conductive segments comprises a base material and an electrically conductive material layer on the base material.

9. The RF and fluid coupler according to claim 1 wherein each of said electrically conductive segments comprises brass.

10. A system comprising:

a subterranean assembly having at least one fluid passageway therein comprising an RF antenna, and a coaxial transmission line connected to said RF antenna, said coaxial transmission line comprising an inner conductor and an outer conductor surrounding the inner conductor; and a radio frequency (RF) and fluid coupler coupled to said subterranean assembly and comprising an electrically conductive hollow body comprising a plurality of electrically conductive segments connected together in end-to-end relation at respective joints to provide an outer electrical pathway to connect to the outer conductor of the coaxial transmission line, an elongate conductive member extending within said electrically conductive hollow body to provide an inner electrical pathway to connect to the inner conductor of the coaxial transmission line, a respective dielectric pressure barrier between said elongate conductive member and adjacent portions of said electrically conductive hollow body adjacent each of a pair of joints to define at least one fluid chamber to connect to the at least one fluid passageway of the subterranean assembly, and a fluid port connected to the at least one fluid chamber.

11. The system according to claim 10 wherein said RF and fluid coupler further comprises at least one RF contact between adjacent ones of said plurality of electrically conductive segments at respective joints.

12. The system according to claim 11 wherein said at least one RF contact comprises at least one conductive wound spring.

13. The system according to claim 10 wherein each respective dielectric pressure barrier comprises quartz fiber.

14. The system according to claim 10 wherein said RF and fluid coupler further comprises at least one seal between adjacent ones of said plurality of electrically conductive segments at a respective joint.

15. A method of making a radio frequency (RF) and fluid coupler for a subterranean assembly comprising an RF antenna and a coaxial transmission line connected thereto, the coaxial transmission line comprising an inner conductor and an outer conductor surrounding the inner conductor, the subterranean assembly having at least one fluid passageway therein, the method comprising:

forming an electrically conductive hollow body comprising a plurality of electrically conductive segments connected together in end-to-end relation at respective joints to provide an outer electrical pathway to connect to the outer conductor of the coaxial transmission line;

forming an elongate conductive member to extend within the electrically conductive hollow body to provide an inner electrical pathway to connect to the inner conductor of the coaxial transmission line;

positioning a respective dielectric pressure barrier between the elongate conductive member and adjacent portions of the electrically conductive hollow body adjacent each of a pair of joints to define at least one fluid chamber to connect to the at least one fluid passageway of the subterranean assembly; and forming a fluid port connected to the at least one fluid chamber.

16. The method according to claim 15 further comprising positioning at least one RF contact between adjacent ones of the plurality of electrically conductive segments at respective joints.

17. The method according to claim 16 wherein positioning the at least one RF contact comprises positioning at least one conductive wound spring.

18. The method according to claim 15 wherein the respective dielectric pressure barrier comprises quartz fiber.

19. The method according to claim 15 further comprising positioning at least one seal between adjacent ones of the plurality of electrically conductive segments at a respective joint.

* * * * *